United States Patent [19]

Skovajsa

[11] Patent Number: 4,699,415

[45] Date of Patent: Oct. 13, 1987

[54] PORTABLE DEVICE FOR TRANSPORTING SKIS

[76] Inventor: Joseph Skovajsa, 19, Avenue Vauquelin, 93470 Coubron, France

[21] Appl. No.: 807,838

[22] Filed: Dec. 11, 1985

[30] Foreign Application Priority Data

Dec. 18, 1984 [FR] France ..... 84 19349

[51] Int. Cl.[4] ..... A63C 11/02

[52] U.S. Cl. ..... 294/147; 280/814; 224/917

[58] Field of Search ..... 294/147, 156, 152, 137, 294/143, 148, 149, 150, 151, 153, 154, 155, 157, 159, 161, 162, 163, 165, 167, 169; 211/70.5; 224/270, 917; 280/814, 815

[56] References Cited

U.S. PATENT DOCUMENTS 3,114,487 12/1963 Miller et al. ..... 294/147

FOREIGN PATENT DOCUMENTS 596857 3/1978 Switzerland ..... 294/147

*Primary Examiner*—James B. Marbert

*Attorney, Agent, or Firm*—Fiddler & Levine

[57] ABSTRACT

A portable device for transporting skis comprises a cradle (10) made of a material which is at least semi-rigid and comprising a web (11) which is generally horizontal and two flanges (12, 13) which are generally parallel and vertical and which together with said web define an upwardly open, U-shaped, ski-receiving channel. A belt (20) is fixed to the cradle (10) and is suitable for being worn by the user to hold the cradle (10) substantially at waist height and on the hip of the user.

4 Claims, 2 Drawing Figures

PORTABLE DEVICE FOR TRANSPORTING SKIS

The present invention relates to a device for transporting skis.

BACKGROUND OF THE INVENTION

Skiers find it extremely awkward and tiring to carry their skis in their hands or on their shoulders when going to or coming from ski slopes.

Various devices have already been proposed for attempting to avoid such inconvenience.

For example, hand carts or other wheeled devices have been proposed.

Another proposal consists in providing the skis with handles which are fixed thereto by hinges or which are independent from the skis but are provided with means for fastening to the skis (such as clamps or belts) suitable for surrounding the skis in order to hold them together reliably while they are connected to the handle.

One example of such a handle is shown, for example, in U.S. Pat. No. 3,780,920 (Green). The device described in this document comprises, more particularly, a ski-receiving support and two handles pivotally mounted on said ski-receiving support.

Another device suitable for dragging skis along the ground is described in German patent publication No. DE-C-407 233 (Seidel). This document describes a clamp which is closed by a pivoting loop and which is provided with two external rings to which a belt is fastened. This device is very complex and bulky in that it requires a spacer to be used (as shown in FIG. 5 of said document), or else it requires rings to be present at the ends of the skis (as shown in FIG. 6 of said document). As a result this device is not used in practice.

Another device is described in Swiss patent publication No. CH-A-596 857 (Witmer). This device comprises a C-shaped ski support for receiving the skis in a cantilever configuration and connected to a belt which is held in the hand. The cantilever configuration of the skis makes the device tiring to hold in the hand.

Mention may also be made of U.S. Pat. No. 3,754,420 (Oellerich). However, this document relates to an anti-theft device intended to be fixed on a ski rack rather than to a portable device for transporting skis. The device described in this patent specification comprises a ski-receiving device which is closed by a flap which is then locked in place by a padlock.

All of the above-mentioned devices suffer from drawbacks which mean that they are little used in practice.

In particular, these devices are generally heavy, bulky and very expensive, and as a result they are not usable by skiers on or near ski slopes.

Further, the use of carts and handles or equivalent means as proposed heretofore is often made difficult by snow or ice accumulating on such devices, and indeed they can be become completely unusable when frozen solid.

These various devices all include components which must be moved relative to one another prior to use, and such components are therefore capable of being locked in a single relative disposition by ice. They are thus not particularly suitable for use with skis.

For example, in German patent document No. DE-C-407 233 the closure loop is pivotally mounted relative to the body of the clamp.

In U.S. Pat. No. 3,754,420 the closure flap is displaced in translation, and the padlock also includes mutually displaceable components.

In U.S. Pat. No. 3,780,920 the handles are pivotally mounted relative to the ski-receiving support.

The problem encountered is thus to design a device for transporting skis which is cheap, light, compact, and above all which is simple and easy to use, while remaining completely insensitive to ice and snow, which means it must not require component parts to move relative to one another prior to use.

SUMMARY OF THE INVENTION

Preferred embodiments of the present invention mitigate the above-mentioned drawbacks by providing a portable device for transporting skis, said device comprising, in combination:

a cradle made of a material which is at least semi-rigid, and comprising a generally horizontal web from which two generally parallel and vertically oriented flanges project, said web and said flanges defining an upwardly open, U-shaped, ski-receiving channel; and a belt fixed to said cradle and suitable for being worn by a user in such a manner as to maintain the cradle substantially at waist height and resting on the user's hip.

Such a device is compact and can be worn by a skier while on ski slopes and without getting in the skiers's way while skiing.

BRIEF DESCRIPTION OF THE DRAWING

An embodiment of the invention is described by way of example with reference to the accompanying drawing, in which.

DESCRIPTION OF THE PREFERRED EMBODIMENT

Figure 1:
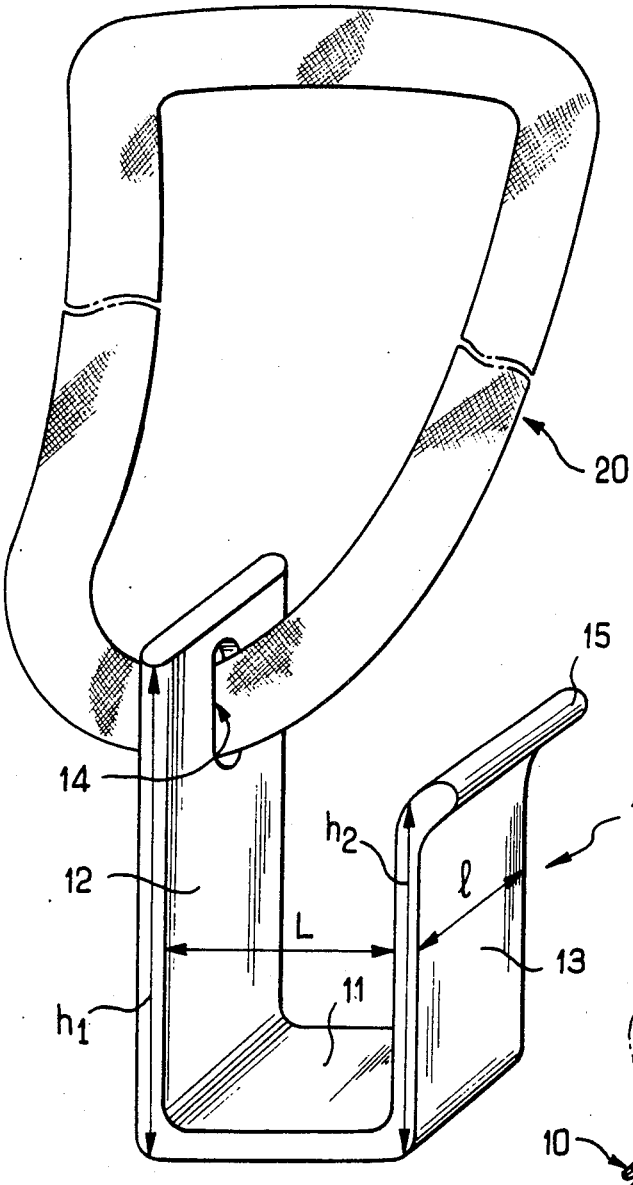
FIG. 1 is a diagrammatic perspective view of a portable device for transporting skis in accordance with a preferred embodiment of the present invention.

As shown in accompanying FIG. 1, a portable device for transporting skis in accordance with the invention comprises a combination of a cradle 10 and a belt 20.

Figure 2:
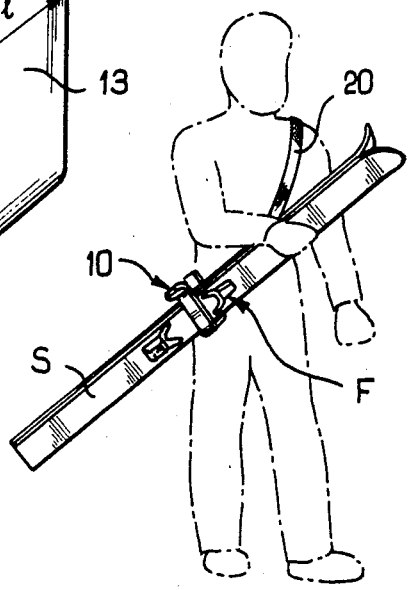
FIG. 2 is a diagram showing such a portable device for transporting skis in use.

The cradle 10 defines an upwardly open, U-shaped ski-receiving channel, as can be seen in FIG. 2.

To this end, the cradle comprises a web 11 which is generally horizontal in use and two flanges 12 and 13 which are generally parallel and vertical in use, with said members 11, 12, and 13 defining the above-mentioned U-shaped channel.

One of the flanges is preferably taller than the other. In FIG. 1, the flange 12 has a height $h_1$ which is greater than the height $h_2$ of the flange 13.

In use, the taller flange 12 lies against the user's hip, and near it free top end it includes at least one opening 14 through which the belt 20 is passed. A plurality of such openings may be provided through the flange 12.

As shown in FIG. 1, the top free end 15 of the second or shorter flange 13 is curved away from the U-shaped ski-receiving channel in order to facilitate inserting skis edgewise into the cradle.

The belt 20 (of which only a part is shown in FIG. 1) comprises a closed loop which passes through the opening 14 and which is suitable for passing over the shoulder of the user while keeping the cradle 10 at waist height, on one side, and over a hip, as shown in FIG. 2.

The belt may be provided with means for adjusting the length of the loop. However, it is preferable for the belt to be in the form of a non-adjustable loop which may be available in several sizes, for example lying in the range 1 m to 1.5 m.

The belt 20 may be fixed to the cradle 10 by any other functionally equivalent means.

In the embodiment which is presently preferred by the Applicant, the cradle is made of thermoplastic material, and advantageously of acetal resins.

In accordance with an important feature of the present invention, the heights $h_1$ and $h_2$ of the flanges 12 and 13 of the cradle 10 and the width L of the ski-receiving channel between said flanges are suitable for engaging part of a ski-binding F against the cradle 10 in a position in which the skis S are inclined to the horizontal, as shown in FIG. 2.

More precisely, an preferably, the width L of the ski-receiving channel between the flanges 12 and 13 of the cradle 10 is less than twice the height of the ski bindings F.

In a preferred embodiment:

the height h1 of the flange 12 is 90 mm;

the height h2 of the web 13 is 50 mm;

the width L of the web 11 is 50 mm;

the flanges 12 and 13 and the web 11 have the same length 1=20 mm and the same thickness of 6 mm; and the opening 14 is 6 mm from the top free end of the flange 12 and extends parallel therealong having a width of 3 mm and a length of 20 mm.

As shown in FIG. 2, the above-described ski-transporting device is used by placing the belt 20 over one shoulder and over the opposite hip, with the cradle 10 being at waist height on the hip and with the U-shaped ski-receiving channel being upwardly open.

The user than inserts the skis into the cradle 10 with the skis being placed sole-to-sole so that their bindings point outwardly. More precisely, the user places the toe bindings ahead of the cradle and slopes the skis relative to the horizontal with the front end pointing upwards and the rear end pointing downwards, as shown in FIG. 2, so that the ski toe bindings located ahead of the cradle come into abutment therewith.

The user then only has to hold the front ends of the skis at substantially chest height in order to stabilize the assembly.

The weight of the skis is supported by the shoulder and the skis disposed to the side of the user do not impede walking.

The skis are easily removed for use or for putting away.

The device in accordance with the invention may be used for cross-country skis as well as for downhill skis.

For downhill skis, the cradle is preferably engaged round the skis between the toe binding and the heel binding, with the toe binding coming into abutment with the cradle.

Naturally, the present invention is not limited to the above-described embodiment as shown in the figures, but extends to any variant falling within the scope of the claims.

For example, the flanges 12 and 13 could be provided on their inside surfaces with resilient structures integrally molded therewith and suitable for improving gripping or clamping on the skis.

I claim:

1. A portable device for transporting skis, said device comprising, in combination: a cradle made of a material which is at least semi-rigid, and comprising a generally horizontal web from which project two generally parallel and vertical oriented flanges that continue the horizontal dimension, said web and said flanges defining an upwardly open, U-shaped, ski-receiving, channel, wherein the two flanges of the cradle are of different heights, the taller flange including at least one opening passing therethrough at its top end, and the width of the ski-receiving channel between the flanges of the cradle is less than twice the height of the ski toe bindings and greater than twice the thickness of the skis, and a belt passing through the opening of the taller flange of the cradle and suitable for being worn over the shoulder of a user in such a manner as to maintain the cradle substantially at waist height and resting on the user's hip, so that after insertion of the skis in the cradle in a position sloping relative to the horizontal, the skis may freely slide in the cradle with the ski toe bindings coming into abutment with the flanges of the cradle.

2. A portable device for transporting skis according to claim 1, wherein the free end of the smaller flange of the cradle is curved away from the ski-receiving channel to facilitate edgewise insertion of the skis into the cradle.

3. A portable device for transporting skis according to claim 1, wherein the cradle is made of thermoplastic material.

4. A portable device for transporting skis according to claim 3, wherein the cradle is made of acetal resins.

* * * * *